US005783995A

United States Patent [19]

Jackson

[11] Patent Number: 5,783,995

[45] Date of Patent: Jul. 21, 1998

[54] DOORKNOB ASSEMBLY WITH INTRUSION ALARM

[76] Inventor: Coley B. Jackson, 307 Branchwood Ct., Jacksonville, N.C. 28546-5803

[21] Appl. No.: 749,407

[22] Filed: Nov. 15, 1996

[51] Int. Cl.[6] ..... G08B 13/08

[52] U.S. Cl. ..... 340/545; 340/542; 340/541; 340/693; 200/61.67

[58] Field of Search ..... 340/545, 542, 340/541, 593, 693, 565; 200/61.62, 61.64, 61.67

[56] References Cited

U.S. PATENT DOCUMENTS

| | | | |
|---|---|---|---|
| 315,152 | 4/1885 | Leek | 340/542 |
| 3,643,249 | 2/1972 | Haywood | 200/61.64 X |
| 3,828,340 | 8/1974 | Bauer, Jr. et al. | 340/542 |
| 3,866,164 | 2/1975 | Peterson | 340/274 |
| 4,196,422 | 4/1980 | Swigert et al. | 340/542 |
| 4,531,029 | 7/1985 | Trimble | 340/545 X |
| 4,760,380 | 7/1988 | Quenneville et al. | 340/542 |
| 5,179,325 | 1/1993 | Aragon, Jr. | 340/542 X |

*Primary Examiner*—Jeffery Hofsass
*Assistant Examiner*—Anh La
*Attorney, Agent, or Firm*—Griffin, Butler Whisenhunt & Szipl

[57] ABSTRACT

A doorknob system (10) with an intrusion alarm includes a separate U-shaped battery pack (24) having mounting apparatus for mounting the battery pack on an exterior surface of an interior cover plate (22), with interengaging cover-plate and battery pack terminals (62*a,b;* 6*a,b*) for transmitting electrical energy from batteries (54) in the battery pack to an electrical alarm (26). A filler protrusion (44) on the interior cover plate spans legs (24*a,b*) of the U-shaped battery pack. A signal emitter (68) is mounted in the cover plate and first and second signal-actuation switches (70, 72) are mounted on a door latch assembly (20). Free wires (98*a,b*) are provided between the signal emitter and the door latch assembly. The second signal-actuation switch (72) is operated by a lock shaft (28) and a first signal-actuation switch is operated by rotation of a doorknob shaft (78).

21 Claims, 2 Drawing Sheets

FIG. 3
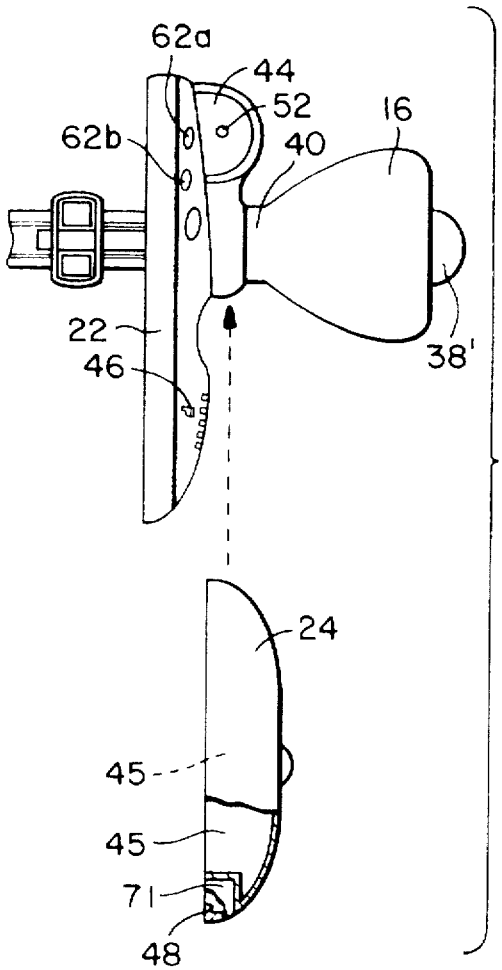
FIG. 4
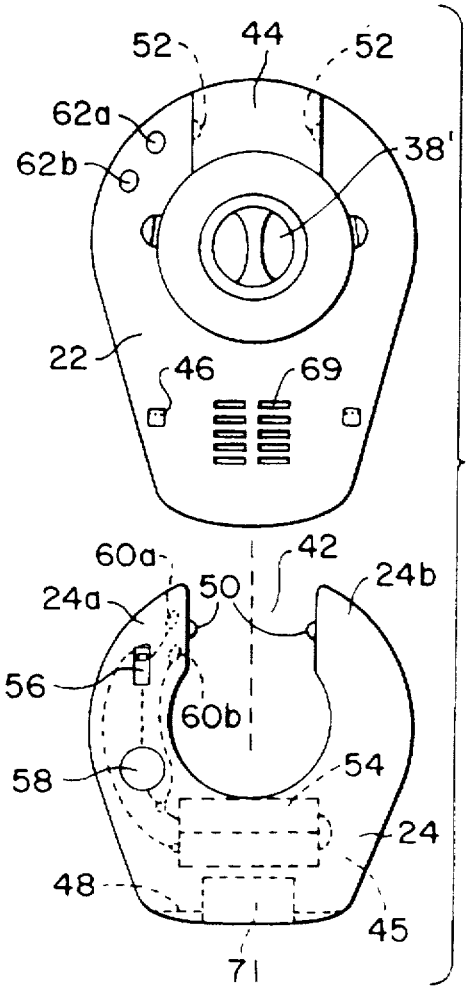
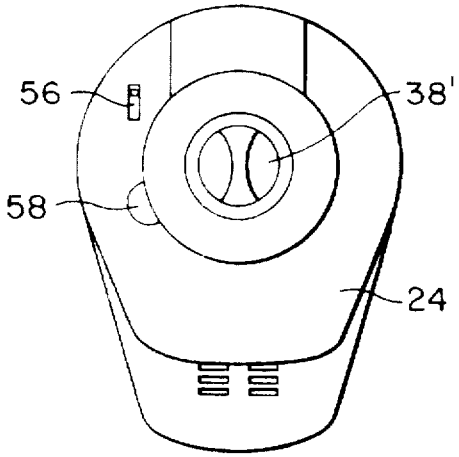
FIG. 5

DOORKNOB ASSEMBLY WITH INTRUSION ALARM

BACKGROUND OF THE INVENTION

This invention relates generally to the art of intrusion alarms and more particularly to intrusion alarms that are mounted directly on doorknobs. Some prior art intrusion alarms mounted on doorknobs are disclosed in U.S. Pat. Nos. 315,152 to Leek; 3,866,164 to Peterson; 4,196,422 to Swigert, et al.; and 4,760,380 to Quenneville, et al.;

Swigert, et al. (U.S. Pat. No. 4,196,422), for example, discloses an intrusion alarm system having a battery pack, an alarm horn, and alarm switches mounted in a cover-plate housing (an escutcheon). The alarm switches are armed and activated by a lock mechanism and a doorknob.

Peterson (U.S. Pat. No. 3,866,164) on the other hand, discloses a security system and lock therefor in which a switch is located on a door latch assembly which is activated by linear movement of an actuating stem within the door latch assembly. The door latch assembly itself, is located at an edge of the door with a doorknob shaft, or spindle passing therethrough. A signal from the switch on the door latch assembly is passed completely through the door and transmitted to an alarm via a hinge. Presumably, this system is powered from wall current.

Such prior art systems have several shortcomings. It is difficult to change batteries of those systems which employ batteries. Further, in some of the systems, such as in a second embodiment of Swigert, et. al., battery packs take up a great deal of room and are, usually, unsightly.

Yet another difficulty with many of these systems is that they require substantial modifications of standard off-the-shelf door handle assemblies.

Still another difficulty with some prior art systems is that they involve the use of switches in doorknobs or door locking mechanisms, which creates problems because most of the parts of the doorknobs and locking mechanisms are necessarily of electricity-conducting metals.

It is an object of this invention to provide a doorknob system with an intrusion alarm which has an easily accessible battery pack for allowing easy access to batteries stored therein, while at the same time which takes up very little space and presents a pleasing exterior appearance.

It is a further object of this invention to provide a doorknob system whose alarm switches are mounted on a component which is normally constructed of an electrically-insulative material, thereby allowing easy mounting of the switches and accurate operation thereof.

Similarly, it is an object of this invention to provide a doorknob system with an intrusion alarm which is highly sensitive to intrusions, but which is only activated when it is locked.

It is also an object of this invention to provide a doorknob system which can be manufactured relatively easily and inexpensively, not requiring major modifications of existing door knob assemblies.

SUMMARY OF THE INVENTION

According to principles of this invention, a separate battery pack is removably mounted on an exterior of a cover plate surrounding a shaft assembly of a knob assembly, while an alarm emitter is mounted on an interior surface of the cover plate. In a preferred embodiment, the separate battery pack has a U-shape, or a horseshoe-shape, for surrounding the doorknob and the shaft assembly. A filler protrusion on the cover plate forms, with the separate battery pack, an annular wreath about the doorknob. The battery pack snaps into place on the exterior surface of the cover plate.

In the preferred embodiment, power from batteries in the separate battery pack are transmitted to a circuit board on the interior surface of the cover plate via spring contacts. First and second signal switches mounted on a door latch assembly are respectively activated by a lock shaft and a knob shaft of the shaft assembly, power being transmitted to the latch assembly via free hanging wires.

BRIEF DESCRIPTION OF THE DRAWING

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 3 is an exploded, partially-segmented, side view of an interior portion of the doorknob system of FIG. 1;

FIG. 4 is an exploded front view of the interior portion, of FIG. 3;

FIG. 5 is a view similar to FIG. 4, but with the separate battery pack being mounted on the cover plate (not exploded);

DESCRIPTION OF THE PREFERRED EMBODIMENT

Figure 6:
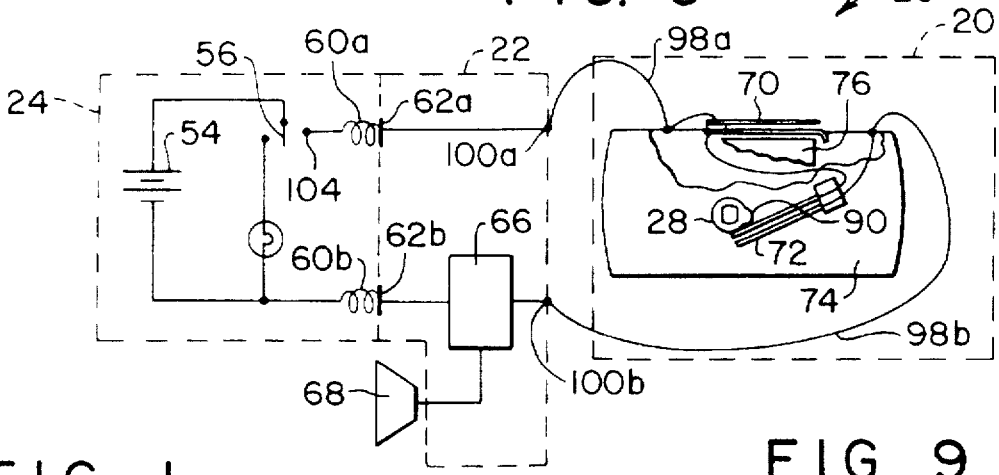
FIG. 6 is a schematic electrical diagram of an electrical circuit of the doorknob system of FIG. 1, a portion of a door latch assembly being shown thereon for illustrating mounting of signal switches of the electrical circuit.
Figure 1:
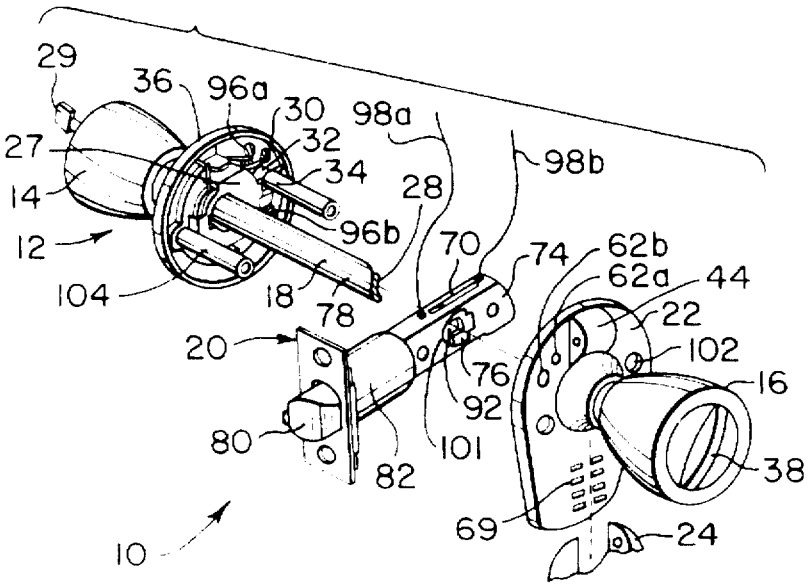
FIG. 1 is a partially segmented, exploded isometric view of most of the elements of a doorknob system of this invention.

A doorknob system 10 includes a knob and locking assembly 12 (including exterior and interior knobs 14 and 16 and a shaft assembly 18 for extending between them), a door latch assembly 20, an interior cover plate 22, a separate battery pack 24 (FIGS. 3–5), and an electrical alarm 26 (shown in detail in FIG. 6).

The knob and locking assembly 12 is substantially the same as knob and locking assemblies of the prior art, for example of the type described in the Peterson (U.S. Pat. No. 3,866,164) as well as in many other patents. Basically, the exterior knob 14 and its exterior cover plate 36 have a locking mechanism 27 therein to be activated by a key 29 for rotating a central locking shaft 28 and for extending locking tabs 30 of a locking tab plate 32. For prior-art devices when the locking tabs 30 were extended, they engaged a post 34 which was fixedly mounted on the exterior cover plate 36 so as to lock the exterior knob 14 (and the interior knob 16, since it is also attached to the shaft assembly 18) from turning. Although the locking tabs 30 are still used for locking in this manner, in the preferred embodiment of this invention they contact flanking locking posts 96 *a, b* for locking, rather than the post 34, as will be further described below. The locking tabs 30 of the locking tab plate 32 can also be extended and retracted by a hand manipulatable locking handle 38 (it is depicted a little differently in FIGS. 3–5 as element 38') on the interior knob 16, since the locking handle 38, 38' engages the locking shaft 28 for rotating it. Thus, the exterior and interior knobs 14 and 16 can be locked against rotation by either the key 29 in the exterior knob 14 or the locking handle 38, 38' on the interior knob 16. The manner in which the locking tabs 30 are moved are not further described herein inasmuch as this is old in the art.

The separate battery pack 24, as can best be seen in FIGS. 3–5, which energizes the electrical alarm 26, has a horseshoe-shape, or U-shape, with left and right arms thereof 24 a and b extending about a neck 40 of the interior knob 16 as well as about the shaft assembly 18. A gap 42 between the left and right arms 24*a* and 24*b* is filled by a filler protrusion 44, which is part of the interior cover plate 22, when the separate battery pack 24 is mounted on the interior cover plate 22. With regard to mounting the battery pack 24 on the interior cover plate 22, in the depicted embodiment, the interior cover plate 22 has brackets 46 thereon which engage in interior shelves 48 formed at a bottom lower edge of the separate battery pack 24. At the same time, left and right arms 24*a* and 24*b* of the separate battery pack 24 have protruding snaps 50 thereon for snapping into indentation snaps 52 in ends of the filler protrusion 44 of the interior cover plate 22. The separate battery pack 24 includes a hollow housing forming a cavity 45 therein for housing batteries 54 in a base of the U-shape, between the left and right arms 24*a,b*. A power switch 56 mounted on the battery pack 24 is a three-way switch having an off position, a light-on position for activating a light 58, and an alarm on position for enabling, or energizing, the electrical alarm 26. Spring electrical contacts 60*a* and 60*b* are mounted in the cavity for passing electrical energy from the batteries 54 to the electrical alarm 26.

The interior cover plate 22 has electrical contacts 62*a* and 62*b* which are respectively, contacted by the resilient spring electrical contacts 60*a* and 60*b* when the separate battery pack 24 is mounted on the interior cover plate 22.

A portion of the alarm circuit 26 is mounted in the hollow interior cover plate 22, on a circuit board 64. A primary portion of the electric alarm 26 which is mounted in the interior cover plate 22 is a signal emitter (such as a horn) 68 and a signal-emitter circuit 66, mounted on the circuit board 64. It will be understood that other types of signal emitters can be used which do not involve audible signals, for example, electromagnetic signals could be emitted causing lamps to blink; however, in the preferred embodiment a noise signal emitter 68 is used and the cover plate 22 has sound holes 69 therein for allowing escape of sound from the interior cover plate 22. The signal emitter circuit 66, used for driving the signal emitter 68, is not further described herein inasmuch as an on-the-shelf circuit is used for this purpose. The housing of the separate battery pack has a hollowed-out portion 71 to ensure that it does not cover the sound holes 69.

Signal-actuation switches for activating the signal emitting circuit 66 are mounted on the door latch assembly 20. FIG. 6 divides the various components of the electrical alarm 26 among the power pack 24, interior cover plate 22, and a door latch assembly 20, using dashed lines.

Figure 2:
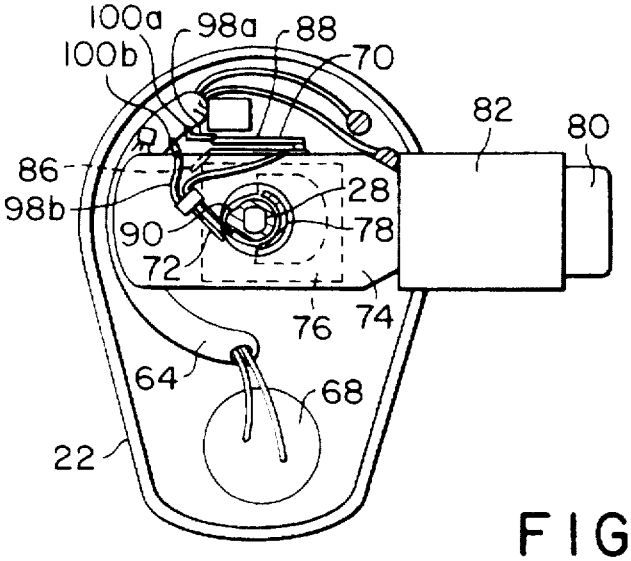
FIG. 2 is rear, partially cross-sectional, view of a door latch assembly and an interior cover plate of the doorknob system of this invention.
Figure 7:
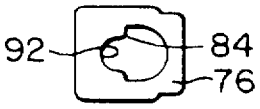
FIG. 7 is a rear view of a latch shuttle plate employed in the door latch assembly of this invention.

First and second signal-actuation switches 70 and 72 (FIGS. 2 and 6) are mounted on a resinous plastic housing 74 of the door latch assembly 20. The first signal-actuation switch 70 is activated by movement of a latch shuttle plate 76 (whose movement is in turn caused by rotation of a knob shaft 78 of the shaft assembly 18) —in many doorknobs the latch shuttle plate is attached to another member (such as an action-sliding latch plate (not shown) in which the latch shuttle plate is mounted) and this member can be used to actually contact the first signal-actuation switch—and the second signal-actuation switch 72 is activated by rotation of the locking shaft 28. As can be seen in FIGS. 2 and 6, the first and second signal-actuation switches 70 and 72 are coupled in series. Interaction between the knob shaft 78 and the latch shuttle plate 76 for retracting a latch 80 in a latch housing 82 is well known in the prior art. Basically, when one of the interior and exterior knobs 14 and 16 is rotated, the knob shaft 78, which has a half annular shape in cross section, is also rotated and its edges press against shoulders 84 (FIGS. 7) on the latch shuttle plate 76 to thereby move the latch shuttle plate 76 to the left as shown in FIG. 2 (or the right as shown in FIG. 6) and retract the linked latch 80. When this done, as can be seen in FIG. 2, an edge of the latch shuttle plate 76 (or an element attached to the latch shuttle plate 76) contacts a bent finger of a movable switch blade 86 of the first signal-actuation switch 70, causing it to contact a second switch blade 88 of the first signal-actuation switch 70 to thereby close the first signal-actuation switch 70 at the beginning of movement of the latch shuttle plate 76.

The second signal-actuation switch 72, on the other hand, is activated by rotation of the locking shaft 28. In this regard, as is mentioned above, the locking shaft 28 is rotated by a key of the exterior knob 14 or the locking handle 38 on the interior knob 16. The second signal-actuation switch 72 is arranged to be closed only when the locking shaft 28 is rotated to a locked position.

Figure 8:
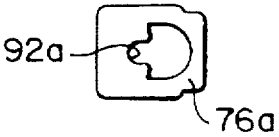
FIG. 8 PRIOR ART
FIG. 8 is a view similar to FIG. 7 of a prior art latch shuttle plate for a similar prior art door latch assembly.

In this regard, the locking shaft 28 is modified from prior art locking shafts to include a cam node 90 on an outer surface thereof at the door latch assembly 20 so as to bend one switch blade of the second signal-actuation switch 72 into contact with another switch blade thereof. In order to accommodate this cam node 90 of the locking shaft 48, it is necessary to enlarge an opening 92 of the latch shuttle plate 76 from an opening 92*a* of a prior-art latch shuttle plate 76*a* (compare FIG. 7 with FIG. 8).

Figure 9:
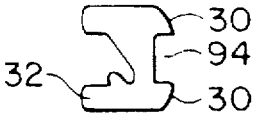
FIG. 9 is a rear view of a locking-tab plate of a doorknob locking mechanism of this invention; and, FIG. 10 is a rear view of a prior art locking tab plate of a similar prior-art doorknob locking mechanism.
Figure 10:
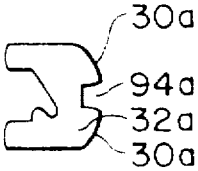
FIG. 10 PRIOR ART

The locking-tab plate 32 (FIG. 9) is also slightly modified from a prior art locking-tab plate 32*a* (FIG. 10) such that its locking tabs 30 are smaller and further apart than are the locking tabs 30*a* of a prior art locking-tab plate 32*a* (compare FIG. 9 with FIG. 10). In order to accomplish this, an opening 94 between the locking tabs 30 is enlarged from an opening 94*a* of the prior-art locking-tab plate 32*a*; thus, the locking tabs 30 are made smaller. By separating the locking tabs 30, more play is created between the locking tabs 30 and the post 34 attached to the exterior cover plate 36. The additional flanking locking posts 96*a* and 96*b* are attached to the exterior cover plate 36 at outside edges of the locking tabs 30 so that they now contact the flanking locking posts 96*a,b* of the post 34.

Describing operation of the doorknob system of this invention, the system is installed substantially as is a standard doorknob system. That is, a doorknob hole is made between exterior and interior faces of the door and a latch hole is placed in an edge of the door extending into the doorknob hole. A door latch assembly 20 is then inserted into this latch hole in the edge of the door with free-hanging wire leads 98*a,b* (which hang from the latch assembly 20) and the plastic housing 74 being inserted first. The wire leads 98*a,b* are then attached to terminals 100*a,b* of the circuit board 64 of the interior cover plate 22. The shaft assembly 18 of the exterior knob 14 is then inserted through the knob hole in the door and simultaneously through the opening 92 in the latch shuttle plate 76, as well as through a hole in the plastic housing 74. Eventually, the exterior cover plate 36 makes contact with an exterior surface of the door. The interior knob 16 is then engaged with the shaft assembly 18 (both with the knob shaft 78 and with the locking shaft 28) and the interior cover plate 22 (which is rotatably coupled to the interior knob 16) is pressed tightly against an interior surface of the door. Bolts passing through bolt holes 102 in the interior cover plate 22 threadingly engage bolt keepers 104 attached to the exterior cover plate 36 to thereby pull the exterior and interior knobs 14 and 16 together on exterior and interior surfaces of the door.

Batteries 54 are then placed in the battery pack 24 and the battery pack 24 is mounted on the outer surface of the interior cover plate 22 so that the spring electrical contacts 60*a* and *b* make contact with the cover plate contacts 62 *a* and *b*. The power switch 56 is then placed in the alarm on position, allowing the alarm to be energized.

Assuming that the locking shaft 28 is in an "unlocked" position (that is, neither the key 29 nor the locking handle 38 have been used to rotate the locking shaft 28), the electrical alarm 26 will not be armed because the second signal-actuation switch 72 is not closed. However, if the locking shaft 28 is rotated, either by the key or the locking handle 38, the cam node 90 on the locking shaft 28 will close the second signal-actuation switch 72 to thereby "arm" the electrical alarm 26.

If, someone then tries to rotate either of the exterior or interior knobs 14 or 16, the latch shuttle plate 76 will be slightly moved by the knob shaft 78 and the movable switch blade 86 of the first signal-actuation switch 70 will be thereby closed, causing current flow through the signal emitting circuit 66 and causing the sound emitter 68 to emit an alarm through the sounds holes 69 in the interior cover plate 22. Because the enlarged opening 94 in the locking-tab plate 32 allows more "play" between the locking tabs 30 and the post 34, sufficient movement of the knob shaft 78 to cause a closing of the first signal-actuator switch 70 is assured, although insufficient movement is allowed for releasing the latch 80 from a doorframe keeper.

It is extremely beneficial that the signal emitting circuit, with its sound emitter (speaker) 68, is located in a separate housing from the separate battery pack 24, with the signal emitting circuit being mounted on one side of the interior cover plate and the battery pack being mounted on the other. In this manner, these items can be axially (in relation to the doorknobs) mounted so that they are more compact and provide a pleasing appearance. By having a separate battery pack, even though the sound emitting circuit and the battery pack are mounted in line with one another, it is still easy to change the batteries because it is easy to remove the battery pack.

Further, it is beneficial that the battery pack includes a power switch for enabling the electrical alarm of this invention and that the power switch is a three way switch which allows a user to alternately activate a light 58 mounted on the battery pack and the alarm system. In this regard, the light 58 can be activated by someone who wishes to bring attention to others the location of the door (such as during a fire).

Another benefit to having a separate battery pack is that the battery pack can be wrapped about the interior door handle so as to provide a space efficient structure as well as an aesthetically pleasing structure. In this respect, it is beneficial that the separate battery pack has a horseshoe shape and that the interior cover plate includes a filler protrusion for filling a gap between left and right arms 24*a,b* of the separate battery pack. Again, this provides a compact and aesthetically pleasing structure.

Placing the first and second signal-actuation switches on the plastic housing 74 of the door latch assembly 20 is also quite beneficial because the plastic of the housing allows the switches to be electrically isolated from other elements of the doorknob system.

It is also beneficial that the system of this invention requires so few changes of prior-art door-knob systems. Thus, the system of this invention can be manufactured relatively inexpensively and easily.

It is beneficial that the first and second signal-actuation switches are operated by rotation of the locking shaft and the knob shaft, because this allows the mounting of these switches with only small modifications to prior-art doorknob systems.

While the invention has been particularly shown and described with reference to a preferred embodiment, it will be understood by those of ordinary skill in the art that various changes in form and detail may be made therein without departing from the spirit and scope of the invention. For example, it would be possible to use only one signal actuation switch, and to not arm the alarm system by locking the doorknobs, but rather to arm it directly-with the power switch 56. Also, it would be possible to place the first and second signal actuation switches 70 and 72 in parallel, rather than in series as depicted, so that manipulation of either the door locking mechanism 27 or the exterior and interior knobs 14 and 16 will cause an alarm signal.

The separate battery pack 24 can be made available in two lengths, the shorter length giving the alarm a very contemporary look and the longer giving the alarm a more traditional look. If the battery pack is made longer, only the last horizontal row of sound holes 69 will be exposed to provide the more traditional look.

The invention claimed is:

1. A doorknob system with an intrusion alarm comprising:

a knob and locking assembly including exterior and interior knobs for being positioned on opposite sides of a door and a shaft assembly for extending between said exterior and interior knobs for being rotated by said exterior and interior knobs and including a door locking mechanism for locking said knobs against rotation;

a door latch assembly for being mounted in the door intermediate said exterior and interior knobs while engaging said shaft assembly, said door latch assembly including a latch housing for being fixedly mounted in said door and a retractable latch for being linked to said shaft assembly and for being movable in said latch housing in response to rotation of said shaft assembly;

an interior cover plate having a shaft opening therein for being mounted on a door surface between said interior doorknob and said door surface, with said shaft assembly passing through said shaft opening;

an electrical alarm mounted in said cover plate between an inner surface of said cover plate and said door for emitting a signal in response to manipulation of one of said exterior and interior knobs, said electrical alarm including an electrical signal emitter and an electrical signal-actuation switch which is switched in response to said manipulation of said exterior and interior knobs, thereby causing said electrical signal emitter to emit a signal;

wherein is further included a separate battery pack including a battery-pack mounting means for mounting said battery pack on an exterior surface of said cover plate, said cover plate and said battery pack respectively including interengaging cover-plate terminals and battery-pack terminals for automatically making electrical contact with one another upon said battery pack being mounted on the exterior surface of said cover plate for transmitting electrical energy from batteries in said battery pack to said electrical alarm.

2. The doorknob system as in claim 1 wherein said battery pack has a U-shape for extending about said shaft assembly and engaging said cover plate on opposite sides of said shaft assembly.

3. The doorknob system as in claim 2 wherein said battery pack has a battery holder for holding batteries in a base of the U-shape, between right and left arms thereof.

4. The doorknob system as in claim 3 wherein at least some of said interengaging cover-plate terminals and battery-pack terminals for automatically making contact are springs.

5. The doorknob system as in claim 2 wherein there is a power switch located on said battery pack for controlling power flowing from batteries located in said battery pack to said electrical alarm.

6. The doorknob system as in claim 5 wherein is further included a light on said battery pack which can be activated by said power switch without activating said electrical alarm by causing power to flow to said electrical alarm.

7. The doorknob system as in claim 2 wherein said cover plate includes a filler protrusion for spanning left and right legs of said U-shaped separate battery pack and being engaged by the battery pack.

8. The doorknob system as in claim 1 wherein said battery pack includes a power switch for controlling flow of electrical energy from batteries mounted in said battery pack to said electrical alarm.

9. The doorknob system as in claim 8 wherein there is a light mounted on said battery pack which can be activated by said power switch without activating said electrical alarm by causing power to flow to said electrical alarm.

10. The doorknob system as in claim 1 wherein said electrical signal-actuation switch is mounted on said door latch assembly.

11. The doorknob system as in claim 1 wherein said shaft assembly includes a locking shaft rotated by said locking mechanism and a knob shaft operated by rotation of said exterior and interior doorknobs, and wherein said signal-actuation switch is switched by said lock shaft, said lock shaft having an eccentric node thereon.

12. The doorknob system as in claim 11 wherein there are first and second signal-actuation switches, the second signal-actuation switch being operated by said locking shaft rotated with operation of said locking mechanism and the first signal-actuated switch being operated by manipulation of the knob shaft by said and exterior and interior knobs.

13. The doorknob system with an intrusion alarm comprising:

a knob and locking assembly including exterior and interior knobs for being positioned on opposite sides of a door and a shaft assembly for extending between said exterior and interior knobs for being rotated by said exterior and interior knobs and including a door locking mechanism for locking said knobs against rotation;

a door latch assembly for being mounted in the door intermediate said exterior and interior knobs while engaging said shaft assembly, said door latch assembly including a latch housing for being fixedly mounted in said door and a retractable latch for being linked to said shaft assembly and for being movable in said latch housing in response to rotation of an element of said shaft assembly;

an electrical alarm for emitting a signal in response to manipulation of one of said exterior and interior knobs, said electrical alarm including an electrical signal emitter and an electrical signal-actuation switch which is switched in response to said manipulation of said exterior and interior doorknobs, thereby causing said electrical signal emitter to emit a signal;

wherein said electrical signal-actuation switch is mounted on said door latch assembly for contacting said shaft assembly to cause said switching of said signal-actuation switch in response to rotation of said shaft assembly.

14. The doorknob system as in claim 13 wherein said shaft assembly comprises a locking shaft which is rotated with operation of said locking mechanism and a knob shaft which is rotated by manipulation of said exterior and interior knobs and wherein there are first and second signal-actuation switches, the second signal-actuation switch being operated by said locking shaft and the first signal-actuation switch being operated by said knob shaft.

15. The doorknob system as in claim 14 wherein said locking shaft has a cam node thereon for operating said second signal-actuation switch.

16. The doorknob system as in claim 15 wherein said locking mechanism is constructed to have much play so as to allow sufficient movement of said exterior and interior knobs to switch said second signal-actuation switch even when said locking mechanism locks said exterior and interior knobs against sufficient movement for releasing said latch from a doorframe.

17. The doorknob system as in claim 16 wherein is further included a plurality of locking posts mounted on an interior cover plate for contacting locking tabs of a locking-tab plate of said locking mechanism with at least two different locking posts.

18. The doorknob system as in claim 13 wherein said locking mechanism is constructed to have much play so as to allow sufficient movement of said exterior and interior knobs to switch said signal-actuation switch even when said locking mechanism locks said exterior and interior knobs against sufficient movement for releasing said latch from a doorframe keeper.

19. The doorknob system as in claim 18 wherein is further included a plurality of locking posts mounted on an interior cover plate for contacting locking tabs of a locking-tab plate of said locking mechanism with at least two locking posts.

20. The doorknob system with an intrusion alarm comprising:

a knob and locking assembly including exterior and interior knobs for being positioned on opposite sides of a door and a shaft assembly for extending between said exterior and interior knobs for being rotated by said exterior and interior knobs and including a door locking mechanism for locking said knobs against rotation;

a door latch assembly for being mounted in a door intermediate said exterior and interior knobs while engaging said shaft assembly, said door latch assembly including a latch housing for being fixedly mounted in said door and a retractable latch for being linked to said shaft assembly and for being movable in said latch housing in response to rotation of an element of said shaft assembly;

an interior cover plate having a shaft opening therein for being mounted on a door surface between said interior doorknob and said door surface, with said shaft assembly passing through said shaft opening;

an electrical alarm for emitting a signal in response to manipulation of one of said exterior and interior knobs, said electrical alarm including an electrical signal emitter and an electrical signal-actuation switch which is switched in response to said manipulation of said exterior and interior doorknobs, thereby causing said electrical signal emitter to emit a signal;

wherein is further included a battery pack including a battery-pack mounting means for mounting said battery pack on an exterior surface of said cover plate;

wherein said battery pack has a U-shape for extending about said shaft assembly and engaging said cover plate on opposite sides shaft assembly.

21. The doorknob assembly as in claim 20 wherein said battery pack terminals and said cover plate has cover-pate terminals which automatically make electrical contact with one another upon said battery pack being mounted on the exterior surface of said cover plate.

* * * * *